US010649385B2

(12) United States Patent
Nishioka

(10) Patent No.: US 10,649,385 B2
(45) Date of Patent: May 12, 2020

(54) IMAGE FORMING DEVICE INCLUDING SHEET CONVEYING PORTION

(71) Applicant: KYOCERA Document Solutions Inc., Osaka-shi (JP)

(72) Inventor: Nobuhiro Nishioka, Osaka (JP)

(73) Assignee: KYOCERA Document Solutions Inc. (JP)

( * ) Notice: Subject to any disclaimer, the term of this patent is extended or adjusted under 35 U.S.C. 154(b) by 152 days.

(21) Appl. No.: 15/884,479

(22) Filed: Jan. 31, 2018

(65) Prior Publication Data

US 2018/0217549 A1 Aug. 2, 2018

(30) Foreign Application Priority Data

Feb. 2, 2017 (JP) ..... 2017-017423

(51) Int. Cl.
*G03G 15/00* (2006.01)
*G03G 21/16* (2006.01)

(52) U.S. Cl.
CPC ..... *G03G 15/657* (2013.01); *G03G 21/1695* (2013.01)

(58) Field of Classification Search
CPC ..... G03G 15/657
USPC ..... 399/400
See application file for complete search history.

(56) References Cited

U.S. PATENT DOCUMENTS 5,016,060 A 5/1991 Arai
5,228,391 A * 7/1993 DeMoore ..... B41F 21/08 101/183
7,623,822 B2 * 11/2009 Matsuno ..... G03G 15/657 271/197
8,714,542 B2 * 5/2014 Tsuji ..... B65H 3/46 271/105
9,164,478 B2 * 10/2015 Hirose ..... G03G 15/657
2014/0376949 A1 * 12/2014 Fujita ..... G03G 21/206 399/92

FOREIGN PATENT DOCUMENTS

JP 2-88961 7/1990
JP 4-59555 2/1992

OTHER PUBLICATIONS

Japanese Office Action dated Sep. 10, 2019.

* cited by examiner

*Primary Examiner* — Anthony H Nguyen
(74) *Attorney, Agent, or Firm* — Gerald E. Hespos; Michael J. Porco; Matthew T. Hespos

(57) ABSTRACT

An image forming device includes a sheet transport portion; an image forming portion; and a sheet conveying portion. The sheet conveying portion includes: a guide plate extending in a sheet width direction; a plurality of guide ribs arranged on the guide plate along the sheet width direction and extending along the sheet convey direction, each having a sheet guide surface guiding the sheet being conveyed; and a suction portion which causes suction air to act on a sheet guided by the guide ribs to bring the sheet into close contact with the sheet guide surface via suction holes opened in the guide plate and which is configured to reduce an air amount of the suction air in regions of the guide ribs on the downstream side in the sheet convey direction to be smaller than that in regions of the guide ribs on an upstream side.

7 Claims, 10 Drawing Sheets

IMAGE FORMING DEVICE INCLUDING SHEET CONVEYING PORTION

INCORPORATION BY REFERENCE

The present application claims priority from Japanese Patent Application No. 2017-17423 filed on Feb. 2, 2017, disclosure of which is all incorporated herein.

BACKGROUND

The present disclosure relates to an image forming device including a sheet conveying portion which conveys sheets.

Image forming device such as a printer, a copying machine, a facsimile machine, and the like each include a sheet conveying portion which conveys a sheet to which an image formed by an image forming portion is transferred.

A known sheet conveying portion that conveys a sheet includes a conveyance guide portion provided with a plurality of guide ribs which guide a sheet being conveyed, and a suction portion which causes suction air to act on a sheet guided by the guide ribs to bring the sheet into close contact with the guide ribs in order to ensure stable sheet conveyance performance. In a sheet conveying portion of this kind, a sheet is brought into close contact with the guide ribs by suction air caused by the suction portion and the sheet being thus in close contact is conveyed to a downstream side in a sheet convey direction while being guided by the guide ribs.

SUMMARY

An image forming device according to one aspect of the present disclosure includes a sheet transport portion, an image forming portion, and a sheet conveying portion. The sheet conveying portion conveys a sheet transported from the sheet transport portion to a downstream side in a sheet convey direction via the image forming portion.

The sheet conveying portion includes a guide plate extending in a sheet width direction, a plurality of guide ribs, and a suction portion. The guide ribs are arranged on the guide plate along the sheet width direction, and have sheet guide surfaces which extend along the sheet convey direction and each guide a sheet being conveyed. The suction portion causes suction air to act on a sheet guided by the guide ribs via suction holes opened in the guide plate, thereby bringing the sheet into close contact with the sheet guide surfaces of the guide ribs. The suction portion is configured to reduce an air amount of the suction air in regions of the guide ribs on the downstream side in the sheet convey direction to be smaller than that in regions of the guide ribs on an upstream side.

DETAILED DESCRIPTION

In the following, description will be made of an image forming device according to one embodiment of the present disclosure with reference to the drawings. The following description will be made using XYZ orthogonal coordinate axes regarding directions. An X direction corresponds to a right-left direction (+X represents right and −X represents left), a Y direction corresponds to a front-rear direction (+Y represents the front and −Y represents the rear), and a Z direction corresponds to an up-down direction (+Z represents up and −Z represents down). Additionally, in the following description, the term "sheet" denotes copy paper, coated paper, an OHP sheet, a board, a postcard, tracing paper, other sheet material to be subjected to image forming processing, or a sheet material to be subjected to other arbitrary processing than the image forming processing.

[Entire Configuration of Image Forming Device]

Figure 1:
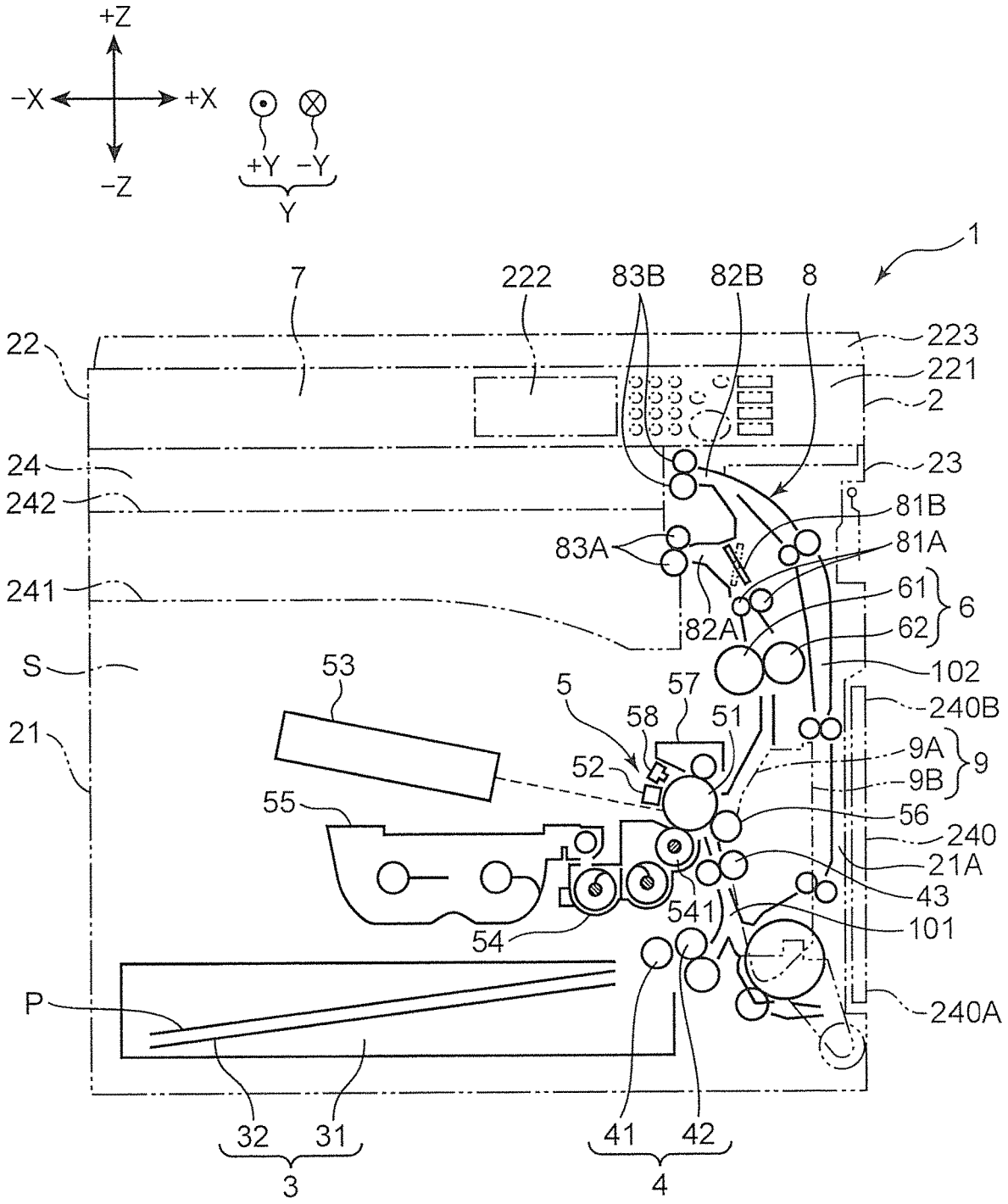
FIG. 1 is a view schematically showing an internal structure of an image forming device including a conveyance unit according to one embodiment of the present disclosure.

FIG. 1 is a view schematically showing an internal structure of an image forming device 1 according to one embodiment of the present disclosure. The image forming device 1 is an electrophotography device which forms an image on a sheet P. Although illustrated here as the image forming device 1 is a monochrome copying machine, the image forming device 1 may be a printer, a facsimile machine, a multifunctional machine having these functions, or a device which forms a color image.

The image forming device 1 includes a device main body 2, and, disposed in the device main body 2, a sheet housing portion 3, a sheet feeding portion 4 (a sheet transport portion), an image forming portion 5, a fixing portion 6, an image reading portion 7, a sheet discharging portion 8, and a conveyance unit 9 (a sheet conveying portion).

The device main body 2 includes a lower casing 21 having a rectangular solid shape viewed from the outside, and an upper casing 22 having a rectangular solid shape and arranged above the lower casing 21. The lower casing 21 and the upper casing 22 are coupled by a coupling portion 23 forming a part of the lower casing 21. The coupling portion 23 is provided to stand from a side portion on a +X side (a right side) of the lower casing 21. The upper casing 22 has a +X side (the right side) region supported by a +Z side (an upper side) end portion (an upper end portion) of the coupling portion 23. To a discharge space 24 surround by the lower casing 21, the upper casing 22, and the coupling portion 23, the sheet P having been subjected to image forming processing is discharged by the sheet discharging portion 8.

In the upper casing 22, the image reading portion 7 is disposed. The image reading portion 7 is an apparatus for reading an image of an original document, and includes an original document holding cover 223 disposed on the +Z side of the upper casing 22. The original document holding cover 223 is up and down rotatably attached to the upper casing 22 and is used for holding an original document. Analog information of an original document image read by the image reading portion 7 is output toward an exposure device 53 to be described later after being converted to a digital signal, and is then supplied to the image forming processing.

Additionally, in a +Y side (a front side) region of the upper casing 22, an operation portion 221 is disposed. The operation portion 221 includes, for example, an LCD (Liquid Crystal Display) touch panel 222. The operation portion 221 is configured to be capable of inputting information about the image forming processing. A user is allowed to input the number of the sheets P to be printed, or input a print density, or the like through, e.g., the LCD touch panel 222.

In the side portion on the +X side of the lower casing 21, a manual feed tray 240 is disposed. The manual feed tray 240 has an upper end 240B side which is up and down rotatably provided, with a lower end 240A as a supporting point. The manual feed tray 240 is configured to have a position thereof changeable between a close position of standing for closing a manual sheet feeding port and an open position of protruding to the +X side. Being set in the open position, the manual feed tray 240 serves for manual feeding of the sheets P one by one.

In an inner space S of the lower casing 21, there are disposed the sheet housing portion 3, the sheet feeding portion 4, the image forming portion 5, the fixing portion 6, the sheet discharging portion 8, and the conveyance unit 9.

The sheet housing portion 3 includes a cassette 31 provided insertable into the lower casing 21 to house the sheet P, and a lift plate 32 which supports the sheet P in the cassette 31. The lift plate 32 slants to push up a front edge of the sheet P to the +Z side.

The sheet feeding portion 4 is a sheet transport portion which transports the sheet P housed in the cassette 31, and includes a pickup roller 41 and a sheet feeding roller 42. In the sheet feeding portion 4, the pickup roller 41 and the sheet feeding roller 42 send out the sheets P housed in the cassette 31 to a main convey path 101 one by one. The main convey path 101 is a convey path disposed so as to pass through a transfer nip portion formed between a photosensitive drum 51 and a transfer roller 56 in the image forming portion 5 from the sheet feeding portion 4 via a resist roller pair 43. The resist roller pair 43 defines a position of the sheet P in a direction orthogonal to a sheet convey direction. The resist roller pair 43 conveys the sheet P to the image forming portion 5 in accordance with timing of transfer of a toner image (developing agent image) onto the sheet P in the image forming portion 5.

The image forming portion 5 subjects, to the image forming processing, the sheet P supplied from the sheet feeding portion 4. The image forming portion 5 includes the photosensitive drum 51, a charger 52, the exposure device 53, a developing device 54, a toner container 55, the transfer roller 56, a cleaning device 57, and a static eliminator 58.

The photosensitive drum 51 is a tubular drum to be rotatably driven around a rotation axis extending in the Y direction (the front-rear direction). The photosensitive drum 51 carries an electrostatic latent image on a circumference surface thereof, as well as carrying a toner image according to the electrostatic latent image. The charger 52 charges the circumference surface of the photosensitive drum 51 before the drum carries an electrostatic latent image.

The exposure device 53 radiates a laser beam to the circumference surface of the photosensitive drum 51 charged by the charger 52 to form an electrostatic latent image. The developing device 54 includes a developing roller 541 which supplies toner (developing agent) to the circumference surface of the photosensitive drum 51 on which surface an electrostatic latent image is formed. The developing roller 541 is a roller which is rotatably driven around a rotation axis parallel to the photosensitive drum 51 and is capable of carrying toner. Upon application of a predetermined developing bias, the developing roller 541 develops an electrostatic latent image formed on the circumference surface of the photosensitive drum 51 with the carried toner. Additionally, the toner container 55 supplies replenishment toner to the developing device 54.

To the photosensitive drum 51 on which a toner image is formed by developing by the developing device 54, the sheet P is sent via the main convey path 101 and the resist roller pair 43. The transfer roller 56 is a roller for transferring a toner image formed on the circumference surface of the photosensitive drum 51 to the sheet P. The transfer roller 56 is rotatable around the rotation axis parallel to the photosensitive drum 51, and is brought into contact with the circumference surface of the photosensitive drum 51 to form the transfer nip portion. To the transfer roller 56, a transfer bias whose polarity is opposite to that of the toner is applied. The sheet P with a toner image transferred is separated from the photosensitive drum 51 and conveyed by the conveyance unit 9 toward the fixing portion 6. Details of the conveyance unit 9 will be described later.

The cleaning device 57 removes toner yet to be transferred which is attached to the circumference surface of the photosensitive drum 51 after toner image transfer. The toner yet to be transferred which has been removed from the photosensitive drum 51 by the cleaning device 57 is conveyed to a toner collection box not shown and is collected. The static eliminator 58 radiates a predetermined charge removal light to the photosensitive drum 51 with the circumference surface cleaned by the cleaning device 57. As a result, residual electric charges on the circumference surface of the photosensitive drum 51 are removed.

The fixing portion 6 has a function of executing fixing processing with respect to the sheet P conveyed by the conveyance unit 9 to be described later. The fixing portion 6 executes the fixing processing with respect to the sheet P to which a toner image has been transferred to fix the toner image on the sheet P. The fixing portion 6 includes a fixing roller 61 internally provided with a heating source, and a pressurizing roller 62 to be pressed against the fixing roller 61 to form a fixing nip portion between the pressurizing roller 62 and the fixing roller 61. When the sheet P to which the toner image has been transferred is passed through the fixing nip portion, the toner image is fixed on the sheet P by heating by the fixing roller 61 and pressing by the pressurizing roller 62.

The sheet P having been subjected to the fixing processing is conveyed to a downstream side in the sheet convey direction by a conveyance roller pair 81A of the sheet discharging portion 8 disposed above the fixing portion 6. On a downstream side of the conveyance roller pair 81A, a discharge branching guide 81B is disposed. The discharge branching guide 81B has a function of switching the convey direction of the sheet P on the downstream side of the conveyance roller pair 81A in the sheet convey direction. The sheet P whose convey direction has been switched by the discharge branching guide 81B is carried in a first discharge path 82A or a second discharge path 82B.

The sheet P having been subjected to the fixing processing, when the sheet is for single-side printing, is discharged toward the discharge space 24 by a first discharge roller pair 83A disposed on the first discharge path 82A, or discharged toward the discharge space 24 by a second discharge roller pair 83B disposed on the second discharge path 82B. The sheet P discharged by the first discharge roller pair 83A to the discharge space 24 is loaded onto a first sheet loading portion 241 arranged on an upper surface portion of the lower casing 21. Additionally, the sheet P discharged to the discharge space 24 by the second discharge roller pair 83B is loaded onto a second sheet loading portion 242 arranged above the first sheet loading portion 241.

On the other hand, when the sheet P having been subjected to the fixing processing is for double-side printing whose one side printing is completed, the sheet P is brought into a state of being sandwiched between the second discharge roller pair 83B disposed on the second discharge path 82B. In this state, the second discharge roller pair 83B is reversed to switch back the sheet P. This causes the sheet P to be reversely sent via a reverse convey path 102, and subsequently supplied again to the image forming portion 5 with top and back sides reversed, so that the back surface side is subjected to the image forming processing. The sheet P whose double-side printing is completed is discharged toward the discharge space 24 via the first discharge path 82A or the second discharge path 82B of the sheet discharging portion 8.

[Detailed Configuration of Conveyance Unit]

Figure 2:
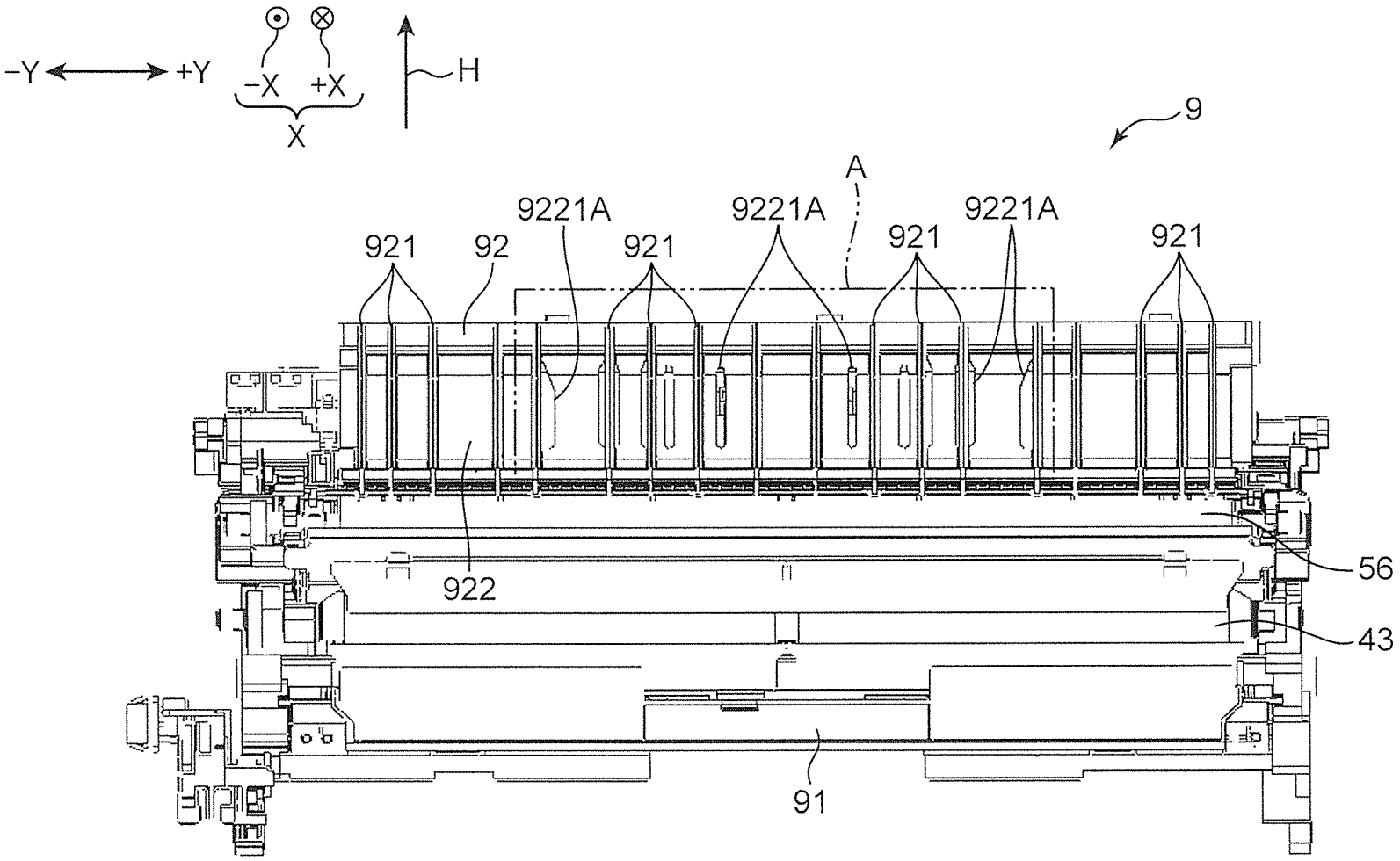
FIG. 2 is a plan view showing a configuration of the conveyance unit.
Figure 3:
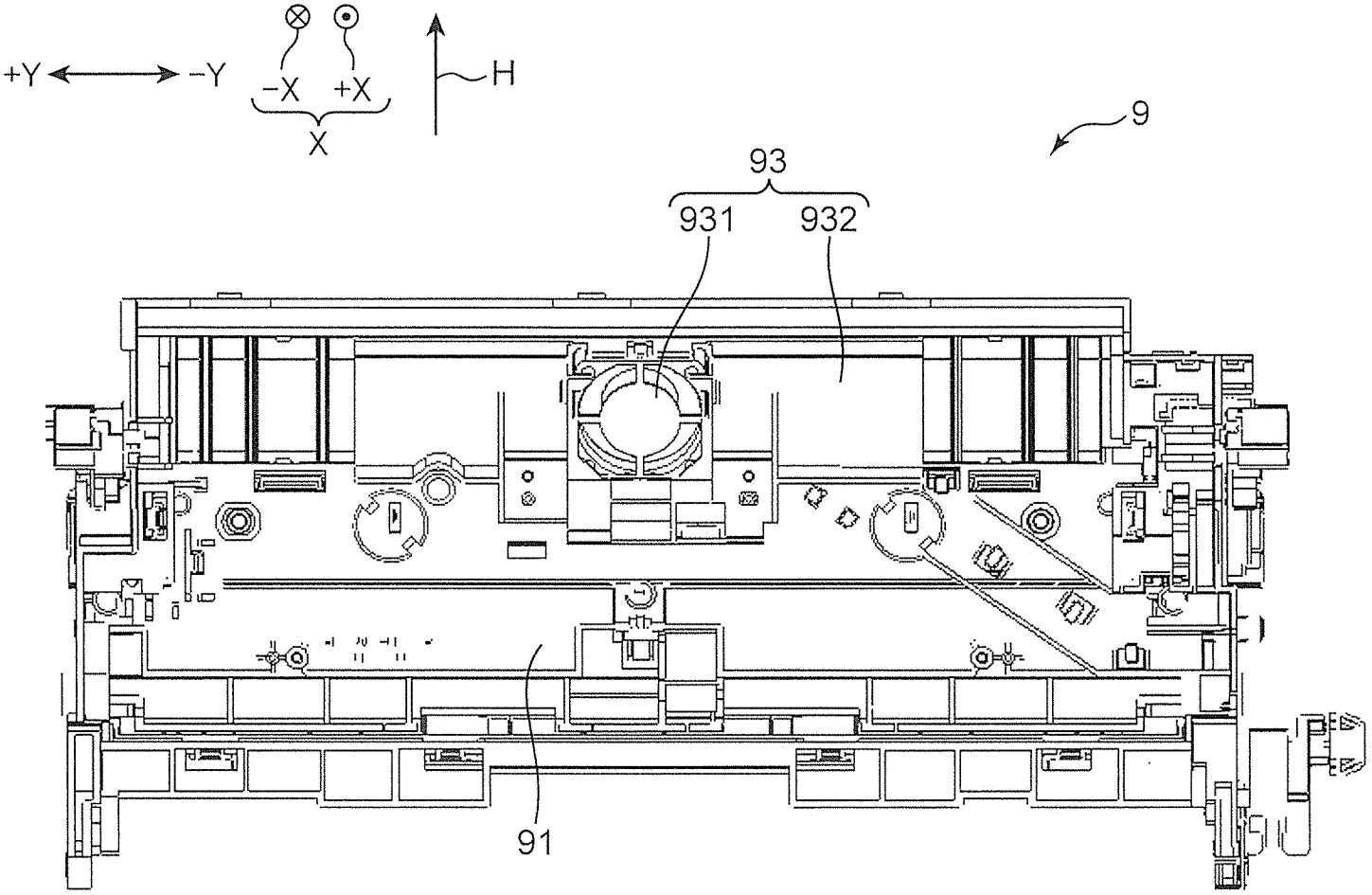
FIG. 3 is a plan view showing a configuration of the conveyance unit.
Figure 4:
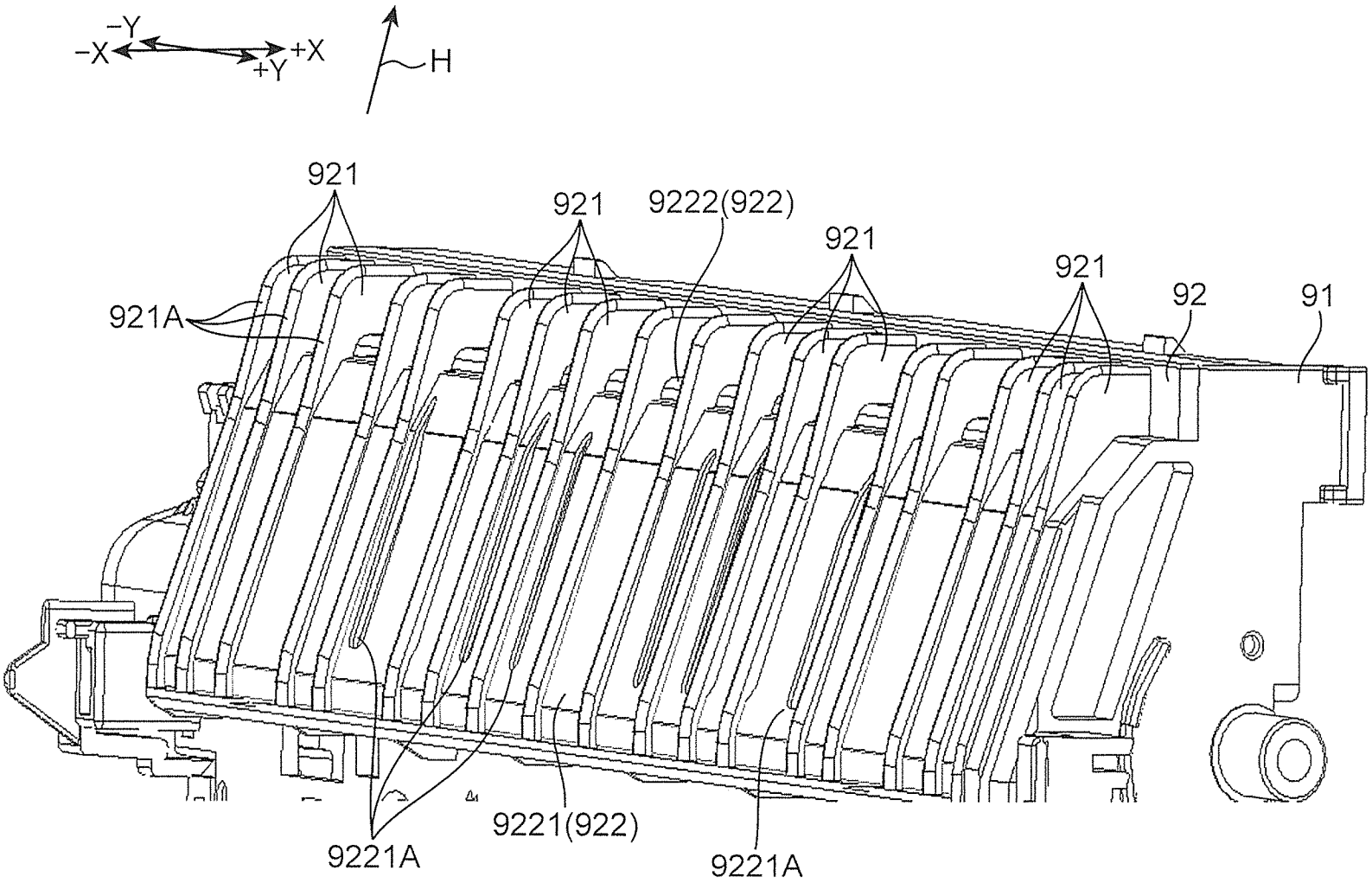
FIG. 4 is a perspective view of the conveyance unit.
Figure 5:
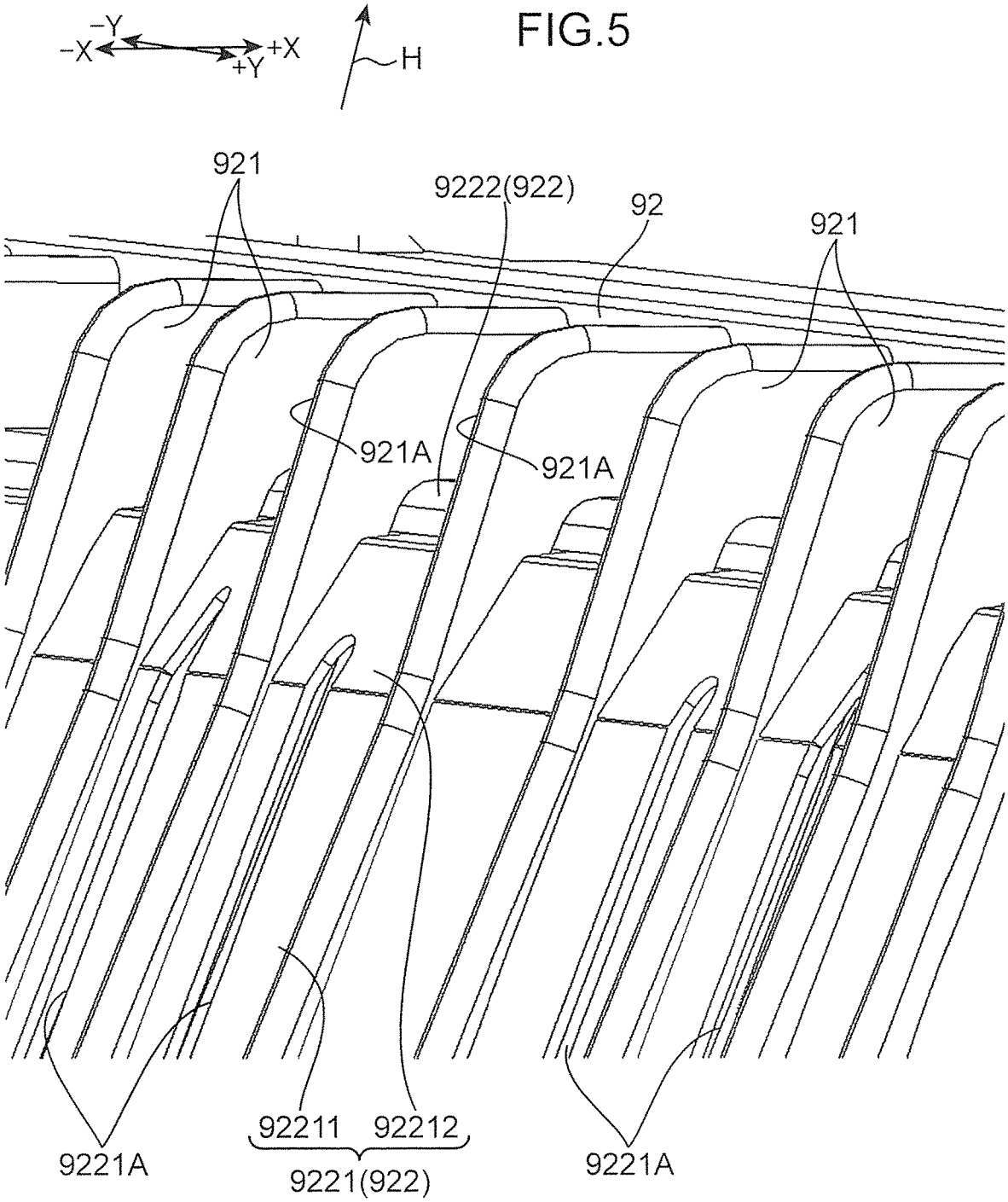
FIG. 5 is an enlarged perspective view showing a main part of the conveyance unit.

Next, a configuration of the conveyance unit 9 will be described in detail with reference to FIG. 2 to FIG. 5. FIG. 2 is a plan view of the conveyance unit 9 seen in a direction from a −X side (the left side) toward the +X side (the right side). FIG. 3 is a plan view of the conveyance unit 9 seen in a direction from the +X side toward the −X side. Additionally, FIG. 4 is a perspective view of the conveyance unit 9, and FIG. 5 is an enlarged perspective view showing a main part of the conveyance unit 9.

The conveyance unit 9 is a unit having a function as a sheet conveying portion which conveys the sheet P transported from the sheet feeding portion 4 to a downstream side in a sheet convey direction H via the image forming portion 5. In the present embodiment, the conveyance unit 9 conveys the sheet P toward the fixing portion 6 arranged on the downstream side of the image forming portion 5 in the sheet convey direction. The sheet convey direction H is substantially the same as a direction from a −Z side (the lower side) toward the +Z side (the upper side).

The conveyance unit 9, as shown in FIG. 1, includes a first side surface 9A opposed to the image forming portion 5 to form the main convey path 101, and a second side surface 9B which is a back surface of the first side surface 9A and opposed to a side surface cover 21A of the device main body 2 to form the reverse convey path 102. Additionally, the conveyance unit 9 includes a conveyance guide portion 92 and a suction portion 93, and a main body frame 91 supporting these portions 92, 93. The above resist roller pair 43 and transfer roller 56 are a part of the configuration of the conveyance unit 9. In the conveyance unit 9, the resist roller pair 43, the transfer roller 56, and the conveyance guide portion 92 are arranged on the first side surface 9A. The conveyance unit 9, which is supported to be able to swing between the device main body 2 and the side surface cover 21A, exposes the main convey path 101 and the reverse convey path 102 by opening of the side surface cover 21A.

The conveyance guide portion 92 forms a region in the conveyance unit 9 on the downstream side in the sheet convey direction H. The conveyance guide portion 92 is disposed between the transfer roller 56 and the fixing portion 6 on the main convey path 101 to guide the back surface side of the sheet P after toner image transfer by the transfer roller 56. The conveyance guide portion 92 includes a guide plate 922 extending in the sheet width direction (the Y direction) orthogonal to the sheet convey direction H, and a plurality of guide ribs 921 arranged on the guide plate 922 along the sheet width direction. In the present embodiment, the main body frame 91 of the conveyance unit 9 is formed of a resin member, and the guide ribs 921 are integrally formed with the main body frame 91.

Each of the plurality of guide ribs 921 arranged on the guide plate 922 extends in the sheet convey direction H, has a sheet guide surface 921A which guides conveyance of the sheet P from the back surface side, and is provided spaced apart in the sheet width direction. In the conveyance guide portion 92, an interval between the guide ribs 921 in the sheet width direction is set so as to enable the sheets P of different sizes to be guided. The sheet guide surfaces 921A of the guide ribs 921 are tip surfaces protruding in the guide ribs 921 to the −X side on the main convey path 101.

The guide plate 922, which is formed with a metal plate member, is attached to a back surface of the guide ribs 921 in the main body frame 91. The guide plate 922 is arranged at a position retracted from the sheet guide surface 912A of the guide rib 921 to a side of a suction fan 931 (the +X side) to be described later. On the guide plate 922, a plurality of suction holes 9221A is formed through which suction air can pass, the suction air being generated by the suction fan 931 in the suction portion 93 to be described later. Details of the guide plate 922 will be described later.

The suction portion 93 is attached to the main body frame 91. The suction portion 93 causes suction air to act on the sheet P guided by the guide ribs 921 via the suction holes 9221A opened in the guide plate 922, thereby bringing the sheet P into close contact with the sheet guide surfaces 921A of the guide ribs 921. The suction portion 93 is configured to reduce an air amount of suction air in a region of the guide rib 921 on the downstream side in the sheet convey direction H to be smaller than that in a region on the upstream side.

In the resist roller pair 43 and the transfer roller 56, and in the conveyance unit 9 including the conveyance guide portion 92 and the suction portion 93, before a front end of the sheet reaches the fixing portion 6, the resist roller pair 43 and the transfer roller 56 convey the sheet P. On this occasion, to prevent the sheet P from fluttering on the conveyance guide portion 92, suction air generated by the suction portion 93 brings the sheet P into close contact with the sheet guide surfaces 921A of the guide ribs 921. While guiding, by the guide ribs 921, the sheet P in close contact with the sheet guide surfaces 921A, the conveyance unit 9 conveys the sheet P to the fixing portion 6.

Here, the suction portion 93 is configured to reduce an air amount of suction air in a region of the guide rib 921 on the downstream side in the sheet convey direction H to be smaller than that in a region on the upstream side, the air which is to be acted on the sheet P via the suction holes 9221A formed in the guide plate 922 as described above. This maintains adhesion of the sheet P caused by relatively strong suction air in the region of the guide rib 921 on the upstream side in the sheet convey direction H, the region being a part of the guide ribs 912 for receiving the sheet P. Accordingly, it is possible, while maintaining stable conveyance state of the sheet P, to reduce the degree of adhesion of the sheet P in the region on the downstream side in the sheet convey direction H, which region serves as a part where the sheet P is transported to the fixing portion 6 in the guide rib 921. It is therefore possible to suppress generation of irregularities in the sheet P in the region of the guide ribs 921 on the downstream side in the sheet convey direction H. Accordingly, the image forming device 1 can be configured to include the conveyance unit 9 having excellent sheet P conveyance performance.

Figure 6:
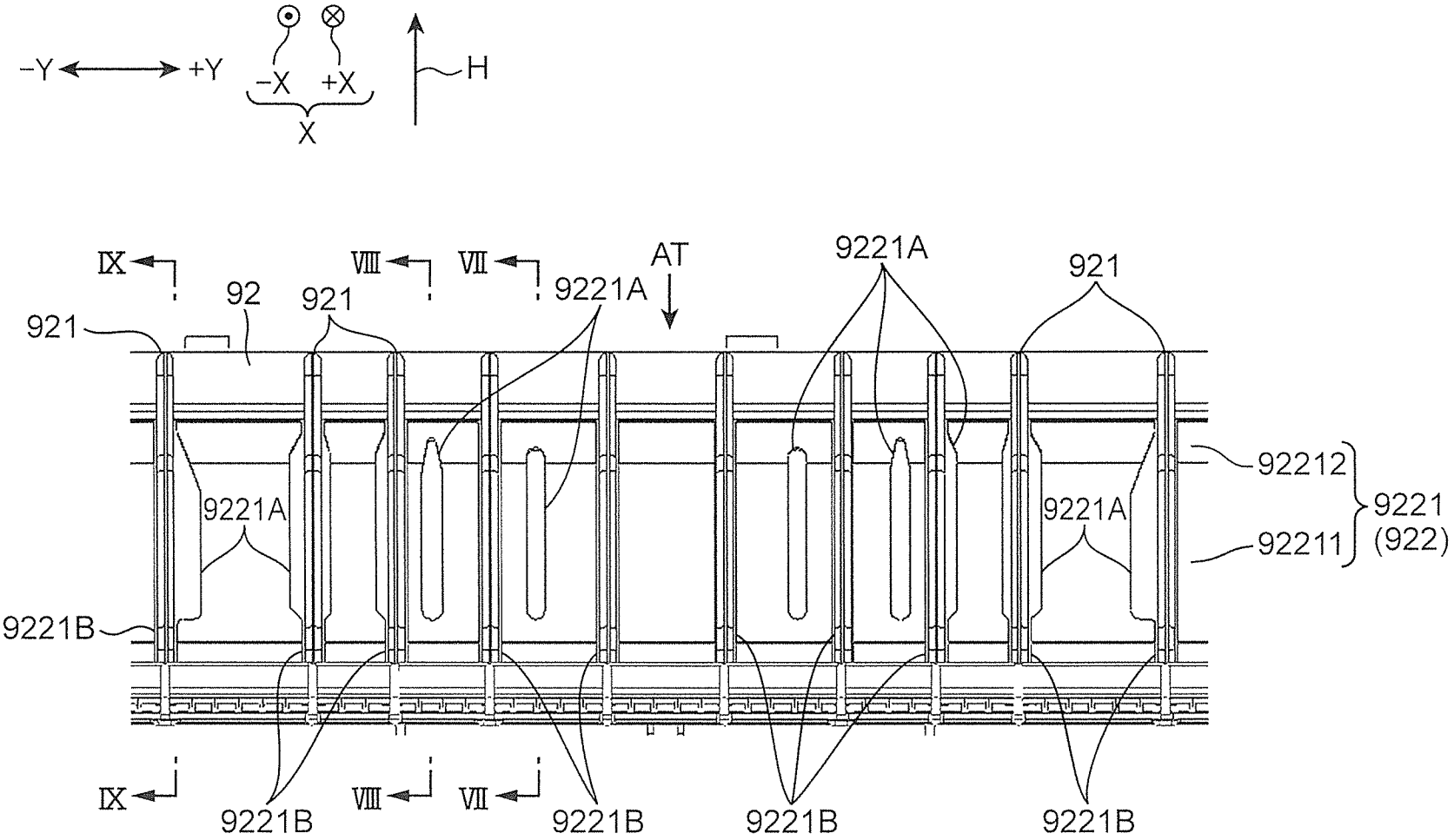
FIG. 6 is an enlarged view of a region A in the conveyance unit shown in FIG. 2.
Figure 7:
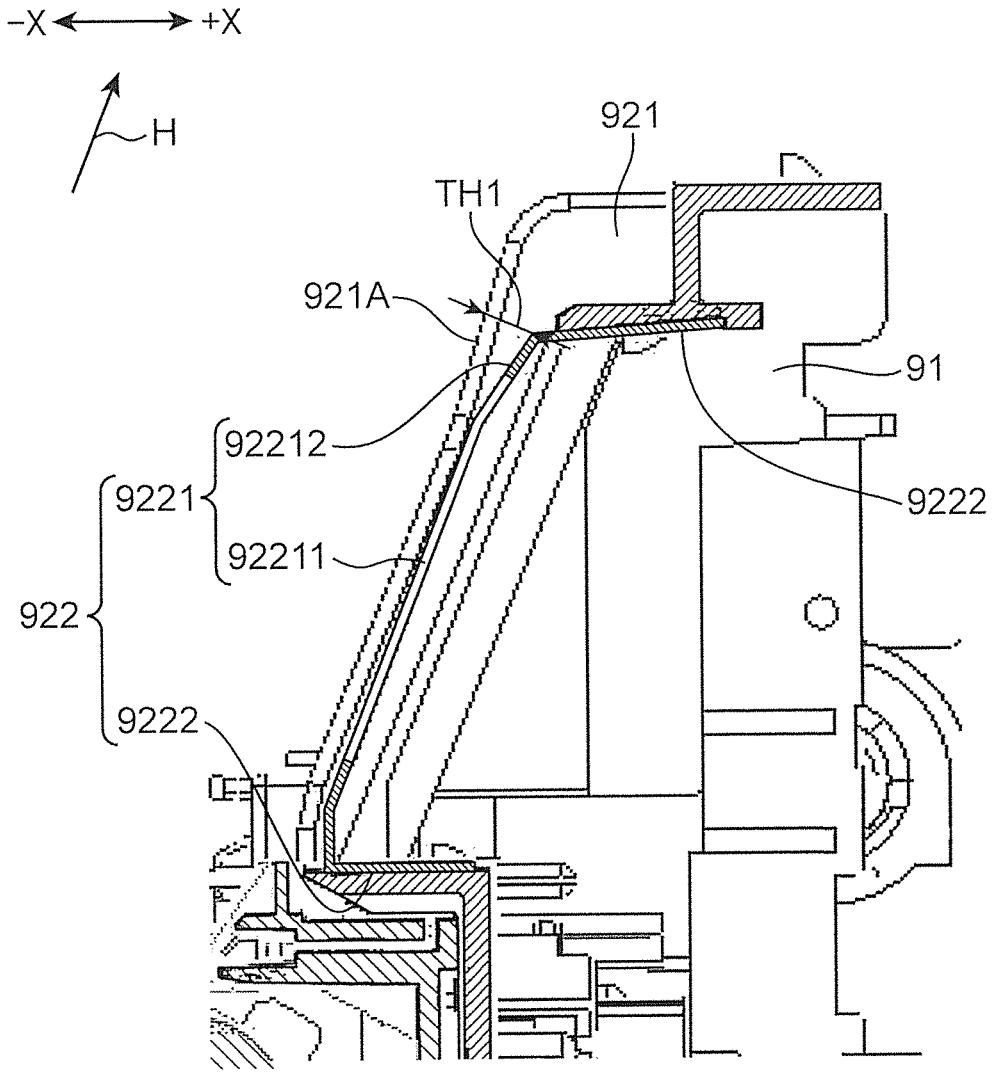
FIG. 7 is a sectional view taken along a cross section line VII-VII shown in FIG. 6.
Figure 8:
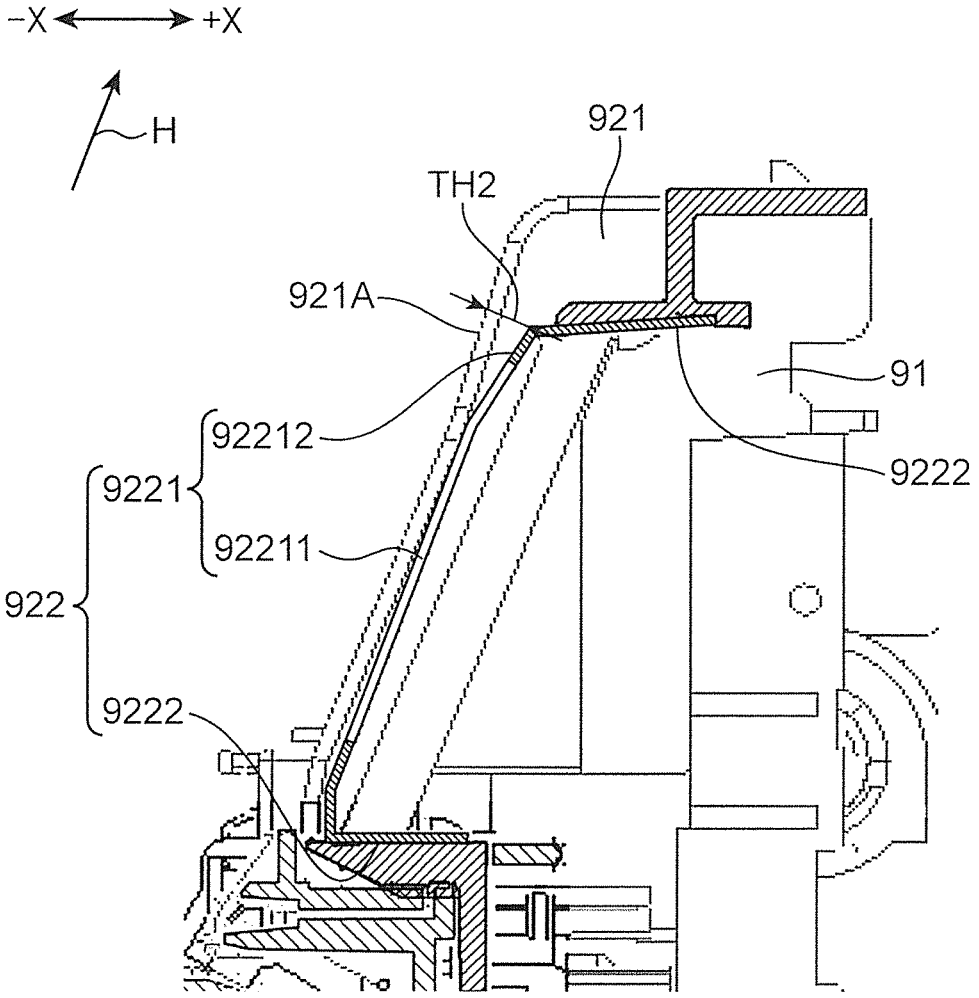
FIG. 8 is a sectional view taken along a cross section line VIII-VIII shown in FIG. 6.
Figure 9:
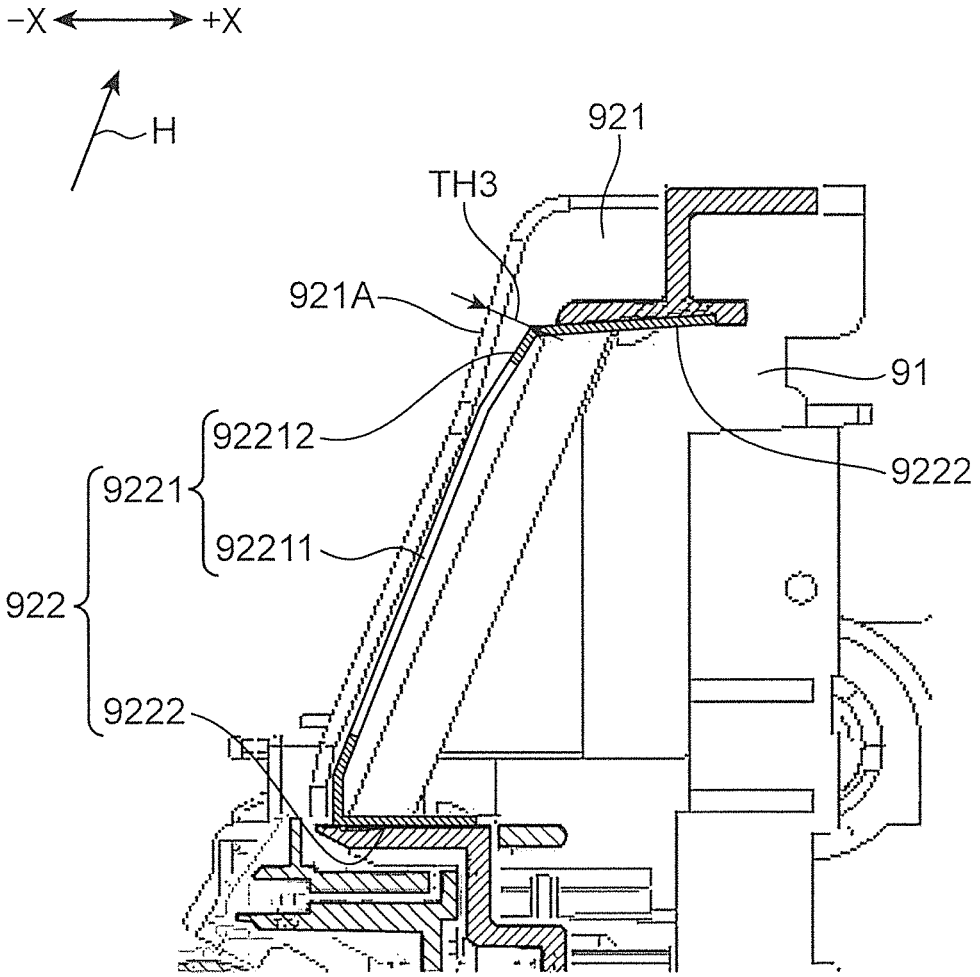
FIG. 9 is a sectional view taken along a cross section line IX-IX shown in FIG. 6.

Next, with reference to FIG. 6 to FIG. 9 in addition to FIG. 2 to FIG. 5, details of the conveyance unit 9 will be described. FIG. 6 is an enlarged view of a region A surrounded by a chain double-dashed line in the conveyance unit 9 shown in FIG. 2. FIG. 7 to FIG. 9 are sectional views of the conveyance unit 9, in which FIG. 7 is a sectional view taken along a cross section line VII-VII shown in FIG. 6, FIG. 8 is a sectional view taken along a cross section line VIII-VIII shown in FIG. 6, and FIG. 9 is a sectional view taken along a cross section line IX-IX shown in FIG. 6. The suction portion 93 is configured to include the suction fan 931 (FIG. 3) and a suction duct 932 (FIG. 3).

The suction fan 931 is arranged on the +X side (the right side) with respect to the conveyance guide portion 92 to generate suction air to be acted on the sheet P guided by the guide ribs 921. The suction fan 931 sucks air present on the −X side (the left side) of the conveyance guide portion 92 via the suction holes 9221A of the guide plate 922. This suction causes generation of suction air to flow from the −X side to the +X side of the conveyance guide portion 92 to generate a negative pressure between the sheet guide surfaces 921A of the guide ribs 921 and the sheet P.

The suction duct 932 is a duct which is attached to the main body frame 91 so as to cover the conveyance guide portion 92 from the +X side and defines a flow path through which suction air generated by the suction fan 931 flows. To the suction duct 932, the suction fan 931 is attached.

Additionally, the guide plate 922 is arranged at a position retracting from the sheet guide surfaces 921A of the guide ribs 921 to the suction fan 931 side (the +X side) as shown in FIG. 5, and FIG. 7 to FIG. 9. The guide plate 922 has the guide plate main body portion 9221 and an attachment portion 9222.

The guide plate main body portion 9221 is a part facing the sheet P guided by the guide ribs 921 and having the plurality of suction holes 9221A formed. Each of the plurality of suction holes 9221A formed on the guide plate main body portion 9221 allows passage of suction air generated by the suction fan 931. The suction holes 9221A are each a long hole extending along the sheet convey direction H and are aligned in the sheet width direction (the Y direction). Additionally, at least one suction hole 9221A of the plurality of suction holes 9221A has a downstream side thereof tapered in the sheet convey direction H. In the present embodiment, as shown in FIG. 6, other suction holes 9221A than the two suction holes 9221A formed at positions closest to a center portion AT of the guide plate main body portion 9221 in the sheet width direction (the Y direction) are configured to have downstream sides thereof tapered in the sheet convey direction H.

As shown in FIG. 7 to FIG. 9, the guide plate 922 is bent from an upstream end and a downstream end of the guide plate main body portion 9221 in the sheet convey direction H to the +X side, and the bent part makes the attachment portion 9222. The guide plate 922 is attached to the main body frame 91 via the attachment portion 9222.

Additionally, the guide plate main body portion 9221 is formed with insertion holes 9221B into which the plurality of guide ribs 921 is inserted, respectively. Each insertion hole 9221B is formed in the guide plate main body portion 9221 to linearly extend along the sheet convey direction H so as to overlap the guide ribs 921 in plan view vertical to the sheet P guided by the guide ribs 921. In the conveyance guide portion 92, with the guide ribs 921 being inserted into the insertion holes 9221B of the guide plate 922, the sheet guide surfaces 921A of the guide ribs 921 are exposed from the guide plate 922 to the −X side.

The insertion holes 9221B are hole portions into which the guide ribs 921 are inserted, and gap portions formed between open edges of the insertion holes 9221B and the guide ribs 921 allow passage of suction air generated by the suction fan 931. In the guide plate 922, the suction holes 9221A may be integral with the insertion holes 9221B.

In thus configured conveyance unit 9, suction air generated by the suction fan 931 passes through the suction holes 9221A formed in the guide plate 922 to act on the sheet P guided by the guide ribs 921. This causes the sheet P, in a state of being in close contact with the sheet guide surfaces 921A of the guide ribs 921, to be conveyed to the fixing portion 6 while being guided by the guide ribs 921. Here, each of the plurality of suction holes 9221A formed in the guide plate 922 is a long hole extending along the sheet convey direction H as described above. Then, at least one suction hole 9221A of the plurality of suction holes 9221A has a downstream side thereof tapered in the sheet convey direction H.

Thus, it is possible to reduce an air amount of suction air in the region of the guide rib 921 on the downstream side in the sheet convey direction H to be smaller than that in a region on the upstream side, the air being to be acted on the sheet P. This enables reduction in the degree of adhesion of the sheet P in the region on the downstream side in the sheet convey direction H, which region serves as a part where the sheet P is transported to the fixing portion 6 in the guide rib 921, thereby suppressing irregularities from being generated in the sheet P. Accordingly, the image forming device 1 can be configured to include the conveyance unit 9 having excellent sheet P conveyance performance.

Additionally, as shown in FIG. 5, and FIG. 7 to FIG. 9, in the guide plate 922, the guide plate main body portion 9221 is configured to include a base portion 92211 and a slant portion 92212. The sheet guide surfaces 921A of the guide ribs 921 linearly extend in parallel to the sheet convey direction H. Then, in the guide plate 922, the base portion 92211 is a plane part provided to extend in parallel to the sheet guide surface 921A of the guide rib 921. In the guide plate 922, the slant portion 92212 is a part continuous to the downstream end of the base portion 92211 in the sheet convey direction H and slanting to a direction separating from the sheet guide surface 921A of the guide rib 921 (the direction from the −X side toward the +X side). Then, the suction hole 9221A is formed over the base portion 92211 and the slant portion 92212.

In the guide plate 922 including the base portion 92211 and the slant portion 92212, the suction hole 9221A is configured such that a region, in the guide plate 922, corresponding to a slant portion 93212 on the downstream side in the sheet convey direction H is spaced more apart from the sheet guide surface 921A of the guide rib 921 than a region corresponding to the base portion 92211 in the guide plate 922. This reliably enables reduction in the degree of adhesion of the sheet P guided by the guide ribs 921 with the sheet guide surfaces 921A more in the region of the guide ribs 921 on the downstream side in the sheet convey direction H than in the region on the upstream side. This enables more reliable suppression of generation of irregularities in the sheet P in the region on the downstream side in the sheet convey direction H, the region serving, in the guide rib 921, as a part where the sheet P is transported to the fixing portion 6. Accordingly, the image forming device 1 can be configured to include the conveyance unit 9 having excellent sheet P conveyance performance.

Additionally, with reference to FIG. 3 and FIG. 6, the suction fan 931 is arranged substantially at the center of the guide plate 922 in the sheet width direction (the Y direction). In the configuration in which the suction fan 931 is arranged substantially at the center in the sheet width direction, an air amount of suction air acting on the sheet P guided by the guide ribs 921 is uneven in the sheet width direction and becomes large in the center portion AT. Therefore, adhesion of the sheet P in the sheet width direction to the sheet guide surfaces 921A of the guide ribs 921 might become uneven.

Under these circumstances, as shown in FIG. 6, in the guide plate 922, the plurality of suction holes 9221A through which suction air generated by the suction fan 931 passes is each configured such that as compared with the suction hole 9221A located in the center portion AT in the sheet width direction, the suction hole 9221A located at the end portion is apt to have a larger length in the sheet convey direction H or a larger length in the sheet width direction. Specifically, the plurality of suction holes 9221A arranged in the sheet width direction is selected to have a length size or a width size increased as a distance of the hole from the center portion AT to the end portion is increased. This makes an air amount of suction air acting on the sheet P guided by the guide ribs 921 be even in the sheet width direction. It is therefore possible to approximate to be even the adhesion of the sheet P to the sheet guide surfaces 921A of the guide ribs 921 in the sheet width direction.

Additionally, as shown in FIG. 7 to FIG. 9, the plurality of guide ribs 921 may be configured such that the guide rib 921 located at the end portion in the sheet width direction is apt to have a shorter spaced distance of each sheet guide surface 921A from the downstream end of the slant portion 92212 in the sheet convey direction H than the guide rib 921 located in the center portion AT in the sheet width direction is.

FIG. 7 to FIG. 9 are sectional views showing cross sections of regions in the conveyance unit 9 apart, in the order of FIG. 7, FIG. 8, and FIG. 9, from the center portion AT in the sheet width direction (the Y direction). With reference to the sectional views shown in FIG. 7 to FIG. 9, in the guide ribs 921 at the respective positions, as a distance of the sheet guide surface 921A from the downstream end of the slant portion 92212 in the sheet convey direction H, a spaced distance TH1 shown in FIG. 7 is, for example, 3.2 mm, a spaced distance TH2 shown in FIG. 8 is, for example, 3.0 mm, and a spaced distance TH3 shown in FIG. 9 is, for example, 2.6 mm.

In such a configuration where a spaced distance from the slant portion 92212 of each sheet guide surface 921A is changed in the sheet width direction, the farther to the end portion is located the suction hole 9221A from the suction hole 9221A in the center portion AT in the sheet width direction, the shorter becomes a spaced distance of each of the plurality of suction holes 9221A formed in the guide plate 922 from the sheet guide surface 921A. This makes it possible to approximate to be more even the adhesion of the sheet P in the sheet width direction to the sheet guide surfaces 921A of the guide ribs 921 even in a configuration in which the suction fan 931 is arranged substantially at the center of the guide plate 922 in the sheet width direction.

Additionally, as shown in FIG. 6, in plan view vertical to the sheet P guided by the guide ribs 921, at least one suction hole 9221A of the plurality of suction holes 9221A formed in the guide plate 922 may be adjacent to the guide rib 921. In the plan view, the suction hole 9221A adjacent to the guide rib 921 is integral with the insertion hole 9221B into which the guide rib 921 is inserted in the guide plate 922. Such configuration suppresses an end portion of the sheet P which is brought into close contact with the sheet guide surfaces 921A of the guide ribs 921 by suction air from entering the suction hole 9221A adjacent to the guide rib 921 as soon as possible. It is therefore possible to maintain excellent sheet P conveyance performance.

Figure 10:
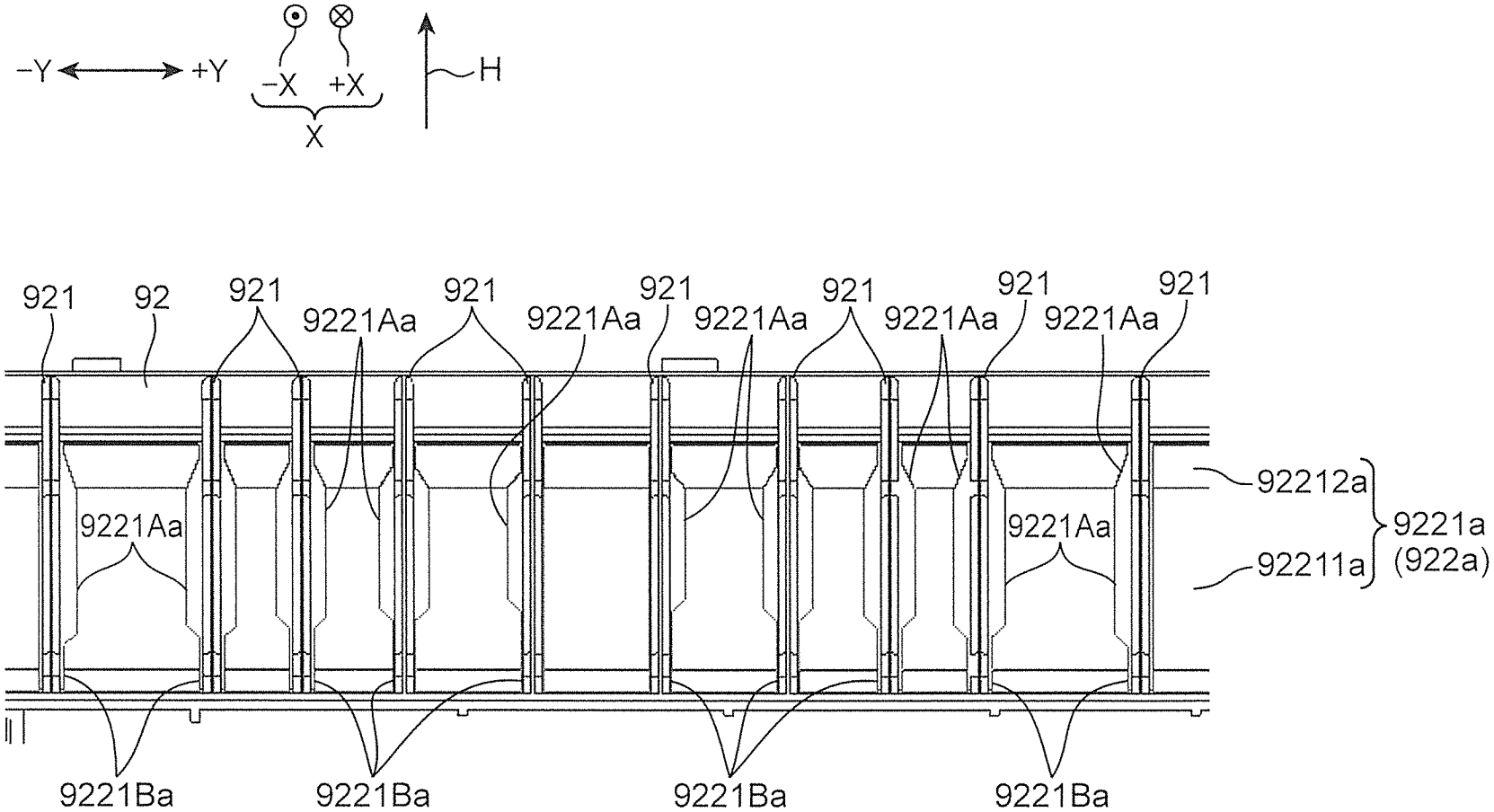
FIG. 10 is a view showing a modification example of a guide plate in the conveyance unit.

Next, a modification example of the guide plate in the conveyance unit 9 will be described with reference to FIG. 10. FIG. 10 is a view showing a guide plate 922*a* in the conveyance unit 9.

The guide plate 922*a*, similarly to the above-described guide plate 922, is arranged at a position retracted from the sheet guide surfaces 921A of the guide ribs 921 to the suction fan 931 side (the +X side). The guide plate 922*a* has a guide plate main body portion 9221*a* which faces the sheet P guided by the guide ribs 921 and is formed with a plurality of suction holes 9221Aa arranged in the sheet width direction (the Y direction). In the guide plate main body portion 9221*a*, insertion holes 9221Ba are formed corresponding to the guide ribs 921, respectively, the insertion holes 9221Ba serving as hole portions to which the guide ribs 921 are inserted. Further, the guide plate 922*a*, similarly to the above-described guide plate 922, is configured to include a base portion 92211*a* provided to extend in parallel to the sheet guide surface 921A of the guide rib 921, and a slant portion 92212*a* continuous to the downstream end of the base portion 92211*a* in the sheet convey direction H and slanting in a direction separating from the sheet guide surface 921A. Then, in the guide plate 922*a*, each suction hole 9221Aa is formed to extend over the base portion 92211*a* and the slant portion 92212*a*.

The respective suction holes 9221Aa formed in the guide plate 922*a* are long holes extending along the sheet convey direction H, and all the suction holes 9221Aa have downstream sides thereof in the sheet convey direction H tapered. Thus, it is possible to reduce an air amount of suction air in the region of the guide rib 921 on the downstream side in the sheet convey direction H to be smaller than that in the region on the upstream side, the air being to be acted on the sheet P. This enables reduction in the degree of adhesion of the sheet P in the region on the downstream side in the sheet convey direction H, which region serves as a part where the sheet P is transported to the fixing portion 6 in the guide rib 921, so that it is possible to suppress generation of irregularities in the sheet P. In the guide plate 922*a*, an upstream side of the suction hole 9221Aa in the sheet convey direction H is also tapered. Opening areas of the tapered regions at the upstream side and the downstream side of the suction holes 9221Aa in the sheet convey direction H are set to be larger on the downstream side than the upstream side.

Further, the plurality of the suction holes 9221Aa formed in the guide plate 922*a* are formed such that the suction hole 9221Aa located at the end portion in the sheet width direction is larger in a length in the sheet convey direction H or in a length in the sheet width direction than in the suction hole 9221Aa located in the center portion AT. This makes an air amount of suction air acting on the sheet P guided by the guide ribs 921 be even in the sheet width direction. It is therefore possible to make even the adhesion of the sheet P to the sheet guide surfaces 921A of the guide ribs 921 in the sheet width direction.

Further, all the suction holes 9221Aa formed in the guide plate 922*a* are adjacent to the guide ribs 921 in a plan view vertical to the sheet P. Specifically, all the suction holes 9221Aa formed in the guide plate 922*a* are integral with the insertion holes 9221Ba into which the guide ribs 921 are inserted. This configuration makes it possible to suppress the end portion of the sheet P brought into close contact with the sheet guide surfaces 921A of the guide ribs 921 by suction air from entering any suction hole 9221Aa. Therefore, excellent sheet P conveyance performance can be maintained.

Additionally, the image forming device 1 according to the present embodiment includes the conveyance unit 9 which enables suppression of generation of irregularities in the sheet P in the region of the sheet P on the downstream side in the sheet convey direction H, the region serving, in the guide rib 921, as a part where the sheet P is transported to the fixing portion 6. Accordingly, reduction in quality of an image formed on the sheet P can be suppressed, the reduction being caused by a failure in conveyance.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming device comprising:

a sheet transport portion;

an image forming portion which forms an image on a sheet; and a sheet conveying portion which conveys a sheet transported from the sheet transport portion to a downstream side in a sheet convey direction via the image forming portion; wherein the sheet conveying portion includes;

a guide plate extending in a sheet width direction orthogonal to the sheet convey direction, guide ribs that are arranged on the guide plate along the sheet width direction and extend along the sheet convey direction, each of the guide ribs having a sheet guide surface guiding the sheet being conveyed, and a suction portion having suction holes that open in the guide plate and cause suction air to act on a sheet guided by the guide ribs to bring the sheet into close contact with the sheet guide surfaces of the guide ribs, and wherein the suction portion is configured to reduce an air amount of the suction air in regions of the guide ribs on a downstream side of the guide ribs relative to the sheet convey direction to be smaller than an amount of suction air in regions of the guide ribs on an upstream side of the guide ribs relative to the sheet convey direction.

2. The image forming device according to claim 1, wherein the suction portion includes a suction fan which generates the suction air, each of the suction holes is a long hole extending along the sheet convey direction, a plurality of the suction holes being formed along the sheet width direction, and at least one of the plurality of suction holes has a tapered shape on the downstream side in the sheet convey direction.

3. The image forming device according to claim 2, wherein the guide plate includes:

a base portion parallel to the sheet guide surfaces of the guide ribs; and a slant portion continuous to a downstream end of the base portion in the sheet convey direction and slanting in a direction separating from the sheet guide surfaces, and the suction holes are formed to extend over the base portion and the slant portion.

4. The image forming device according to claim 3, wherein the suction fan is arranged substantially at the center of the guide plate in the sheet width direction, and the plurality of suction holes comprise a suction hole located in the center portion in the sheet width direction and suction holes located at both end portions in the sheet width direction, the suction holes located at both end portions are apt to have larger lengths in the sheet convey direction or larger lengths in the sheet width direction as compared with the suction hole located in the center portion in the sheet width direction.

5. The image forming device according to claim 4, wherein the plurality of guide ribs are set such that the guide ribs located at the both end portions are apt to have shorter spaced distances of each sheet guide surfaces from a downstream end of the slant portion in the sheet convey direction than the guide rib located in the center portion in the sheet width direction is.

6. The image forming device according to claim 2, wherein at least one suction hole formed in the guide plate is adjacent to any one of the guide ribs.

7. The image forming device according to claim 1, further comprising:

a fixing portion arranged on the downstream side of the image forming portion in the sheet convey direction to execute fixing processing of an image on the sheet formed by the image forming portion; wherein the sheet conveying portion conveys the sheet from the image forming portion to the fixing portion.

* * * * *